US009586725B2

(12) United States Patent
Earp

(10) Patent No.: US 9,586,725 B2
(45) Date of Patent: Mar. 7, 2017

(54) EFFLUENT CONTAINER FOR CLEANING HEAT EXCHANGERS

(71) Applicant: The Blast Bag Company, Inc., La Porte, TX (US)

(72) Inventor: Danny Earp, La Porte, TX (US)

(73) Assignee: Danny Earp, LaPorte, TX (US)

( * ) Notice: Subject to any disclaimer, the term of this patent is extended or adjusted under 35 U.S.C. 154(b) by 0 days.

(21) Appl. No.: 14/220,615

(22) Filed: Mar. 20, 2014

(65) Prior Publication Data

US 2015/0266623 A1 Sep. 24, 2015

(51) Int. Cl.

| | |
|---|---|
| ***B65D 33/02*** | (2006.01) |
| ***B65D 33/01*** | (2006.01) |
| ***B65D 33/14*** | (2006.01) |
| ***B65D 33/16*** | (2006.01) |
| ***B65D 85/00*** | (2006.01) |
| ***B08B 17/02*** | (2006.01) |
| ***F28G 9/00*** | (2006.01) |
| ***F28G 15/02*** | (2006.01) |
| *F28G 15/00* | (2006.01) |

(52) U.S. Cl.

CPC ..... *B65D 33/02* (2013.01); *B08B 17/025* (2013.01); *B65D 33/01* (2013.01); *B65D 33/14* (2013.01); *B65D 33/16* (2013.01); *B65D 85/70* (2013.01); *F28G 9/00* (2013.01); *F28G 15/02* (2013.01); *F28G 2015/006* (2013.01); *Y10T 29/49826* (2015.01)

(58) Field of Classification Search

CPC ..... B65D 33/02; B65D 85/70; B65D 33/01; B65D 33/14; B65D 33/16; B08B 17/025; B08B 15/026; B08B 15/02; B08B 3/04; B08B 9/023; Y10T 29/49826; F28G 15/02; F28G 9/00; F28G 2015/006

USPC ..... 220/9.4, 610, 677, 612, 678, 680, 661; 222/173, 185.1, 181.1, 328; 229/117.3

See application file for complete search history.

(56) References Cited

U.S. PATENT DOCUMENTS

| | | | |
|---|---|---|---|
| 3,148,699 | A | 9/1964 | Shindler |
| 3,263,653 | A | 8/1966 | Miller |
| 3,310,322 | A | 3/1967 | Carroll |
| 3,419,151 | A | 12/1968 | Smith et al. |
| 4,207,918 | A | 6/1980 | Burns |
| 4,683,067 | A | 7/1987 | Aleman et al. |
| 4,712,270 | A | 12/1987 | Palmer |

(Continued)

FOREIGN PATENT DOCUMENTS

| | | |
|---|---|---|
| CH | 701338 | 12/2010 |
| DE | 101 22 885 | 11/2002 |

(Continued)

*Primary Examiner* — Robert J Hicks
*Assistant Examiner* — Kareen Thomas
(74) *Attorney, Agent, or Firm* — Baker Hostetler LLP

(57) ABSTRACT

An effluent container may have multiple sheets of material attached together to form a generally rectangular shape, having a front sheet, a back sheet, two side sheets, and a bottom sheet; a securing system attached to a free end of at least one of the sheets and configured to attach the effluent container to a support structure; and a drain located on one of the sheets, proximate to the bottom sheet, the drain configured to provide selective fluid communication between the interior of the container and an outside of the container. A method of forming an effluent container may also be provided.

22 Claims, 4 Drawing Sheets

(56) References Cited

U.S. PATENT DOCUMENTS

| | | | | |
|---|---|---|---|---|
| 4,820,000 | A | 4/1989 | Jacobson | |
| 4,883,329 | A | 11/1989 | Flannery et al. | |
| 4,905,900 | A | 3/1990 | Scharton et al. | |
| 4,950,392 | A | 8/1990 | Tiegs et al. | |
| 4,963,175 | A | 10/1990 | Pace | |
| 5,069,359 | A * | 12/1991 | Liebel | B65D 77/067 222/105 |
| 5,379,810 | A | 1/1995 | Marino | |
| 5,725,009 | A | 3/1998 | Mallow, Sr. et al. | |
| 5,826,752 | A * | 10/1998 | Latimer | B65D 5/5405 220/23.83 |
| 6,053,401 | A * | 4/2000 | Andrews, Sr. | B65D 81/3261 220/495.03 |
| 6,164,345 | A | 12/2000 | Haddox | |
| 6,244,290 | B1 | 6/2001 | Reicin et al. | |
| 6,640,825 | B2 | 11/2003 | McAtarian | |
| 6,877,654 | B2 * | 4/2005 | Bartlett | B65D 77/065 222/105 |
| 7,334,587 | B2 | 2/2008 | Lake | |
| 7,607,564 | B2 * | 10/2009 | Churvis | B65D 77/067 206/386 |
| 7,753,090 | B2 | 7/2010 | Earp | |
| 7,905,368 | B1 | 3/2011 | Christensen | |
| 8,627,999 | B2 * | 1/2014 | Wolf | B65D 5/029 229/117.15 |
| 8,646,679 | B2 * | 2/2014 | Hill | B65D 5/46112 229/117.15 |
| 2004/0190799 | A1 | 9/2004 | Hess | |
| 2006/0023973 | A1 | 2/2006 | Plunkett | |
| 2010/0140263 | A1 | 6/2010 | Claeys | |
| 2011/0048670 | A1 | 3/2011 | Podhorsky et al. | |

FOREIGN PATENT DOCUMENTS

| | | |
|---|---|---|
| EP | 1 510 474 | 3/2005 |
| WO | WO 2013/079345 | 6/2013 |

* cited by examiner

EFFLUENT CONTAINER FOR CLEANING HEAT EXCHANGERS

FIELD OF THE INVENTION

The present invention relates generally to an effluent container for cleaning heat exchangers. More particularly, the present invention relates to a trough shaped container for containing cleaning fluid used for cleaning heat exchangers and fin fan coolers at the operator end.

BACKGROUND OF THE INVENTION

Heat exchangers and coolers such as fin fan coolers, are in need of cleaning. One way of cleaning heat exchangers and fin fan coolers is to flow cleaning fluid (which is often water) through the heat exchanger or cooler. As the cleaning fluid moves through the cooler or heat exchanger, the cleaning fluid may pick up contaminants from the heat exchanger or cooler. The contaminants may have leaked from the heat exchanger or cooler or may be present due to other sources. One tool that may be used in the cleaning process is a hydroblaster. The hydroblaster may discharge cleaning fluid through a cooler or heat exchanger causing the cleaning fluid to flow through the cooler heat exchanger and out the other side.

In view of current environmental concerns, it may be desirable to recapture the cleaning fluid once it has flowed through a cooler or heat exchanger. This may be because the cleaning fluid itself may need proper disposal or that the cleaning fluid, once it has been contaminated by being flushed through the cooler or heat exchanger becomes an effluent that now has contaminants that need to be properly disposed of.

Further, it is possible that a cooler or heat exchanger may leak causing effluent to flow out of the cooler or heat exchanger.

Accordingly, it is desirable to provide an apparatus that allows an effluent flowing out of a structure such as a cooler or heat exchanger to be captured for proper disposal.

SUMMARY OF THE INVENTION

The foregoing needs are met, to a great extent, by the present invention, wherein in one aspect embodiment an apparatus is provided that allows an effluent flowing out of a structure such as a cooler or heat exchanger to be captured for proper disposal.

In accordance with one embodiment of the present invention, an effluent container may be provided. The effluent container may have multiple sheets of material attached together to form a generally rectangular shape, having a front sheet, a back sheet, two side sheets, and a bottom sheet; a securing system attached to a free end of at least one of the sheets and configured to attach the effluent container to a support structure; and a drain located on one of the sheets, proximate to the bottom sheet, the drain configured to provide selective fluid communication between the interior of the container and an outside of the container.

In accordance with another embodiment of the present invention, a method of forming an effluent container may be provided. The method may include: attaching multiple sheets of material together to form a generally rectangular shape, having a front sheet, a back sheet, two side sheets, and a bottom sheet; installing a first closure system on a first side sheet and configuring it to selectively open and close and form a slit in a first side sheet when the first closure system is in an open position; attaching a securing system to a free end of at least one of the sheets; configuring the securing system to attach the effluent container to a support structure; locating a drain on one of the sheets, proximate to the bottom sheet; and configuring the drain to provide selective fluid communication between the interior of the container and an outside of the container.

In accordance with yet another embodiment of the present invention, an effluent container may be provided. The fluid container may include multiple sheets of material attached together to form a generally rectangular shape, having front sheet, a back sheet, two side sheets, and a bottom sheet; means for closing a slit located on a first side sheet and configured to selectively open and close and form a slit in a first side sheet when the means for closing is in an open position; means for securing the container to a structure attached to a free end of at least one of the sheets; and means for draining the container located on one of the sheets, proximate to the bottom sheet, the means for draining configured to provide selective fluid communication between the interior of the container and an outside of the container.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
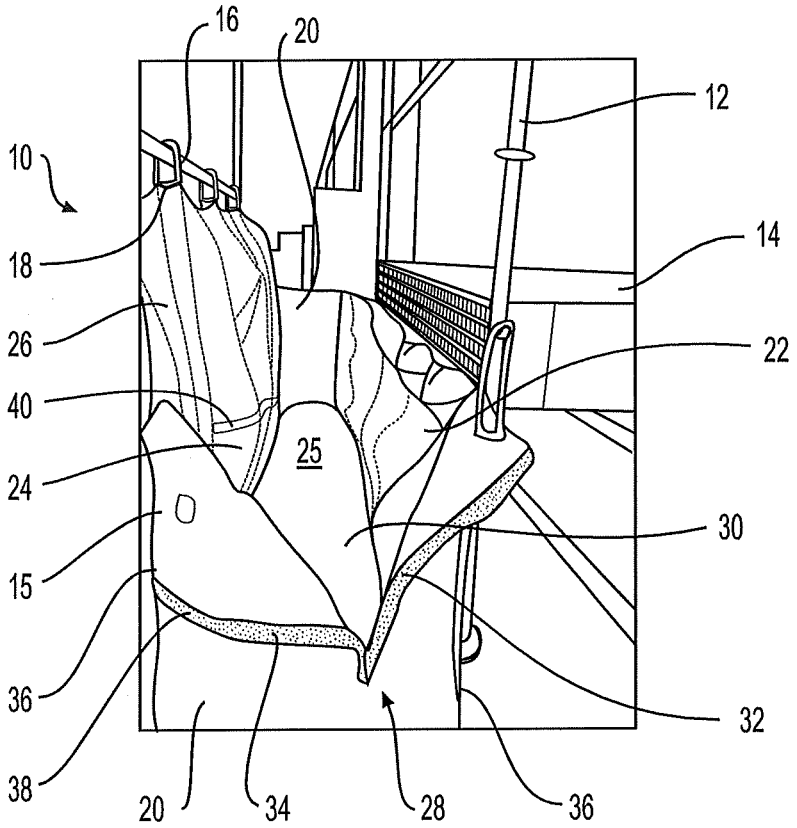
FIG. 1 is a perspective view illustrating a container according to an embodiment in accordance with the disclosure.

The illustrated embodiment will now be described with reference to the drawing figures, in which like reference numerals refer to like parts throughout. An embodiment in accordance with the present invention provides a generally trough shaped container that may be attached to an external structure and placed proximate to a heat exchanger, cooler, or any other device that may generate an effluent. The generally trough shaped container is positioned proximate to the device to capture effluent coming from the device.

FIG. 1 illustrates a side perspective view of the container 10. The container 10 is attached to an external structure 12 that supports and opens the container 10. The container 10 is located near a source 14 of an effluent. The source 14 may be a heat exchanger, a cooler, such as a fin fan cooler, or any other potential source of an effluent.

The container 10 is comprised of several sheets of material 15. The container 10 may be fixed to the structure 12 by securing straps 16 located in securing loops 18. The securing loops 18 may be attached to sidewalls 20, a front wall 22, and a back wall 24. The sidewalls 20, the front wall 22, and the back wall 24 may be made of material 15 and generally form a rectangular-shaped container 10 as shown. However, in other embodiments, other shapes may also be used. The rectangular-shaped container 10 may define an opening 25. The opening 25 is oriented to allow the container 10 to receive an effluent coming from the source 14.

It will be understood that terms used herein to describe relative relationships such as, but not limited to, top, bottom, side, etc. are used with reference to the orientation shown in the drawings. These terms are helpful to describe where objects are relative to each other. It is to be understood that if a container 10 is oriented to a position different than what is shown in the drawings, then such a container 10 will have the same features as those features described in relative terms. One of ordinary skill in the art after reviewing this disclosure will understand what the features of a container 10 described herein are, even if the orientation of a container 10 is changed.

In some embodiments, effluent coming from the source 14 may be flowing toward the opening 25 in the container 10. In embodiments where a hydroblaster or other pressurized cleaning system is used, the effluent may be moving at a relatively high velocity from the source 14 toward the container 10. In such instances, the effluent may strike an extended part 26 of the back wall 24. This extended part 26 of the back wall 24 is raised above the sidewalls 20 and may assist in catching effluent and directing it into the container 10.

The container 10 may include a closing mechanism 28 located in the sidewalls 20 as illustrated. The closing mechanism 28 may selectively open and close a slit 30 in the sidewall 20. In some embodiments, the purpose of the slit 30 is to permit access to the interior of the container 10. Access to the container 10 may be useful while setting up or securing the container 10 to the structure 12. Once it is no longer useful to have the slit 30, the slit 30 may be closed by using the closing mechanism 28. In some embodiments, the closing mechanism 28 may include a hook 32 and loop 34 system such as, for example, but not limited to, Velcro. In other embodiments, the closing mechanism 28 may include straps, a zipper, a cord or any suitable mechanism for closing.

The various sheets or walls 20, 22, 24 and the closing mechanism 28 may be attached to each other by seams. For example, a corner seam 36 attaches the sidewall 20 to the back wall 24 and another corner seam 36 attaches the sidewall 20 the front wall 22 as illustrated in FIG. 1. Other seams 36 may provide a means for attaching as needed. A closing mechanism seam 38 attaching the closing mechanism 28 to the sidewall 20 is also shown. The extended part 26 of the back wall 24 may be attached by an extension seam 40 to a lower portion of the back wall 24 as shown. Other seams may also be present throughout the container 10 as needed. In some embodiments, the seams may be formed by one or more of the following methods: sewing, heat welding, sonic welding, impulse welding, epoxies, adhesives or any other suitable way of attaching sheets of material 15 together.

Figure 2:
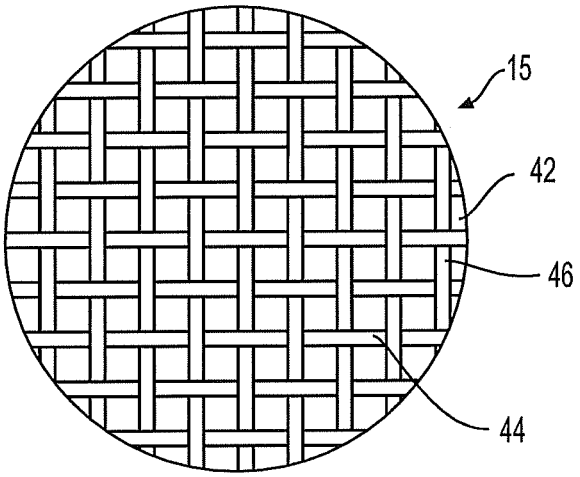
FIG. 2 is a top view of a sample fabric that may be used in accordance with the disclosure.

FIG. 2 is an enlarged partial view of the material 15 used in some embodiments to form the container 10. In some embodiments, the material 15 may include a low density polyethylene (LDEP) 42 and may be reinforced with fibers 44, 46 such as, for example, but not limited to, nylon fibers. The fibers 44 may run horizontally and the fibers 46 may run vertically. The combination of these fibers 44 and 46 may form a grid-like structure. In some embodiments, the longitudinal fibers 44 may be interwoven with the latitudinal fibers 46. The nylon fibers 44 and 46 may be embedded in the low density polyethylene 42.

In some embodiments, the fabric 15 may be translucent or even transparent. These features will allow a user to monitor the amount of effluent contained within the container 10. In some embodiments, symbols, logos, trademarks or other writing such as instructions or other useful information may be printed on the material 15. In some embodiments, the material 15 made of multiple plies. In some embodiments the material 15 may withstand temperatures up to 172° F.

The container 10 may be constructed of material 15 configured to withstand fluid pressure up to 40,000 PSI. Fluids at such pressure may originate from a hydroblaster. The container 10 may come in a variety of sizes such as 2 foot to 20 foot lengths. For example, standard sized containers 10 may include 4, 6, 8, 10, 12, 14 16, 18, and 20 foot lengths. Other sizes larger, smaller and in between those mentioned may also be used.

Figure 3:
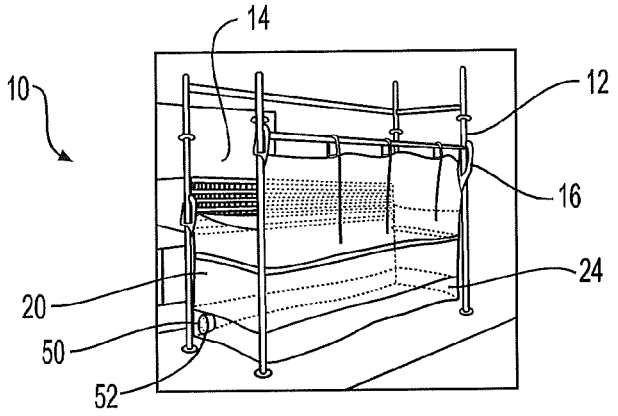
FIG. 3 is a rear, perspective view of a container attached to an external structure in accordance with the disclosure.

FIG. 3 is a rear perspective view of the container 10 attached to structure 12. As shown, the container 10 is located near an effluent source 14 and oriented to catch effluent emanating from the source 14. The securing straps 16 secure the back wall 24 of the container 10 to the structure 12. The securing straps 16 may also be attached to some of the other walls. The drain 50 is shown extending from the bottom of the sidewall 20. The drain 50 includes a removable drain cap 52. In some embodiments the drain 52 is threadably attached to the drain 50 for removal and securing as desired. In some embodiments, the threads on the drain 50 may also be configured to attach to a conduit such as a hose for draining effluent pooled within the container 10.

Figure 4:
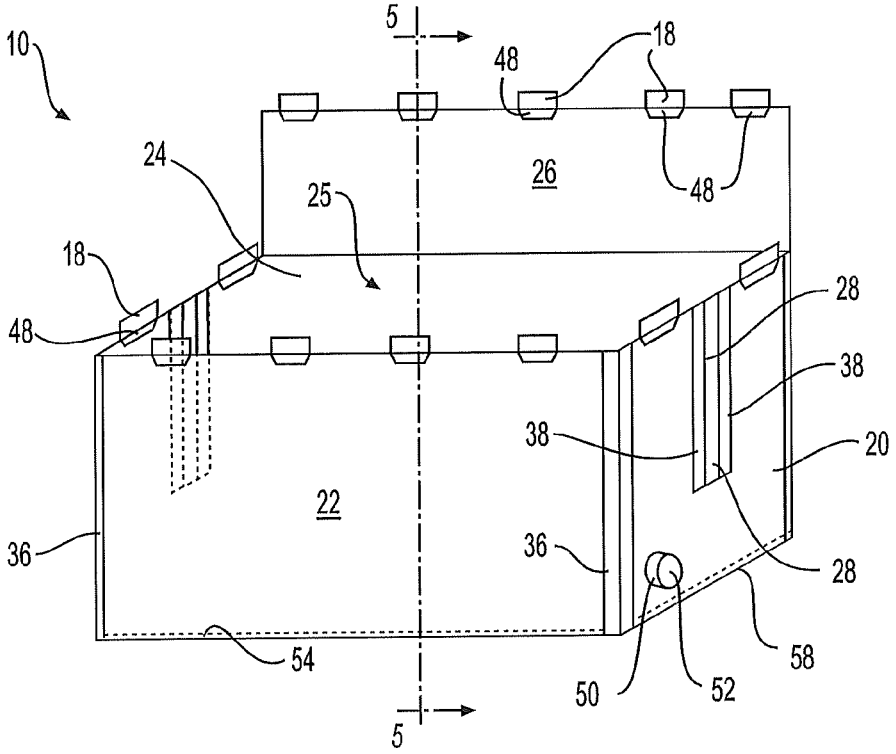
FIG. 4 is a front, perspective view of the container in accordance with the disclosure.

FIG. 4 is a front perspective view of a container 10 in accordance with the present disclosure. The back wall 24 and the extended part 26 of the back wall 24 are shown. Securing loops 18 are attached via securing loops seams 48 to the sidewall 20, front wall 22, and back wall 24. Corner seams 36 are also shown attaching the various walls 20, 22, and 24. The bottom seam 54 attaches the various sidewalls 20, front wall 22, and/or back wall 24 to the bottom sheet 58. The container 10 is in a generally rectangular shape having an opening 25. The closing mechanism 28 is shown attached to the sidewalls 20 by closing mechanism seams 38.

The drain 50 and drain cap 52 are also shown. The location of the drain 50 is meant to be an example only. In other embodiments, the drain 50 may be located at various locations including the sidewall 20 as shown, the front wall 22, or back wall 24. In some embodiments, the drain may be a 2 inch NPT fitting for allowing easy connection to a non-collapsible hose for the convenient routing of waste-water and or other effluent. In some embodiments, a 3 inch drain 50 may be provided. Other embodiments may include different sized drains 50.

Figure 5:
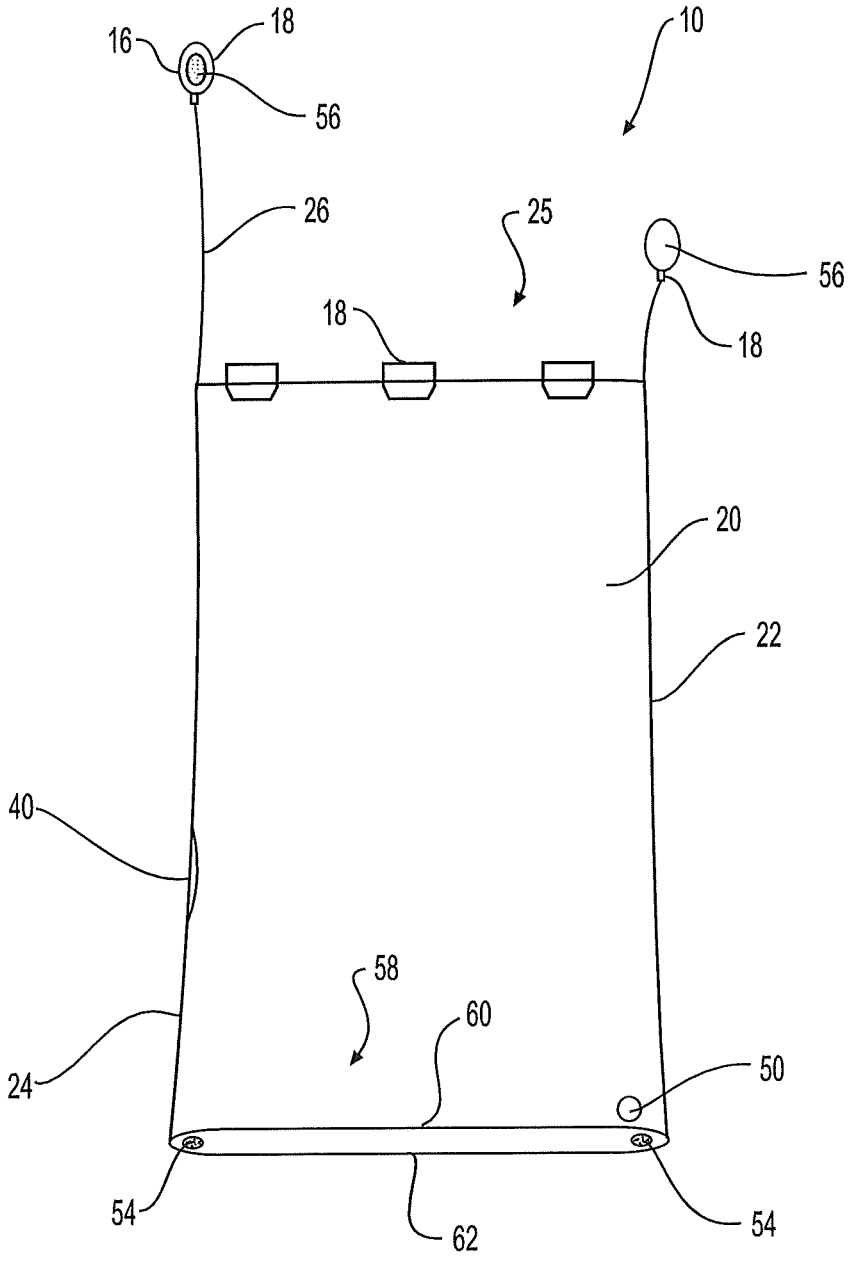
FIG. 5 is a cross-sectional view taken along the lines 5-5 in FIG. 4.

FIG. 5 is a cross-sectional view of the container 10 taken along the line 5-5 in FIG. 4. The securing straps 16 are located within the interior 56 of the securing loops 18. The extended part 26 of the back wall 24 is shown extending above both the top of the sidewalls 20 back wall 24 has an extending seam 40 which connects various portions of the back wall 24. In some embodiments, the material 15 which forms the back wall 24 may be of sufficient length to not require an extending seam 40 in the front wall 22.

While the illustrated embodiment shows that the back wall 24 is taller than the sidewalls 20 and the front wall 22, and the front wall 22 is taller than the sidewalls 20, various different embodiments are not limited to this geometry. In other embodiments, the sidewalls 20, the front wall 22, and the back wall 24 may be of different relative heights to each other. In some embodiments, the sidewalls 20 may be about 3.5 feet high. The back wall 24 may be about 6 feet high and the front wall may be about 4 feet high. These or other dimensions may be used.

One of ordinary skill in the art after reviewing this disclosure will understand what height of the various walls are suitable for its specific application. It will be understood that the anticipated direction and velocity of the effluent flowing out of the structure 12 will be taken into account when selecting walls of various heights. As discussed above, is desirable to have the effluent be contained by the container 10 as much as possible to minimize splash or spill out of the container 10 into the surrounding environment.

The bottom sheet 58 is shown attached via bottom seams 54 to the front wall 22 and the back wall 24. The drain 50 is also shown. While not shown in FIG. 5, FIG. 4 illustrates an additional bottom seam 54 attaching the bottom sheet 58 to the side walls 20. In some embodiments, the bottom sheet 58 may have multiple plies. In a two-ply embodiment, the bottom sheet 58 may be comprised of a first ply 60 and a second ply 62 the two plies 60 and 62 may be connected to each other at the bottom seams 54 as indicated. In other embodiments, the first ply 60 second ply 62 may be attached other suitable locations. Any of the walls may also have multiple plies.

In some embodiments, the container 10 is attached to the structure 12 by securing straps 16. The securing straps 16 may be equipped with buckles 64 which allow a simple and easy way to secure the securing straps 16 to the structure 12.

Figure 6:
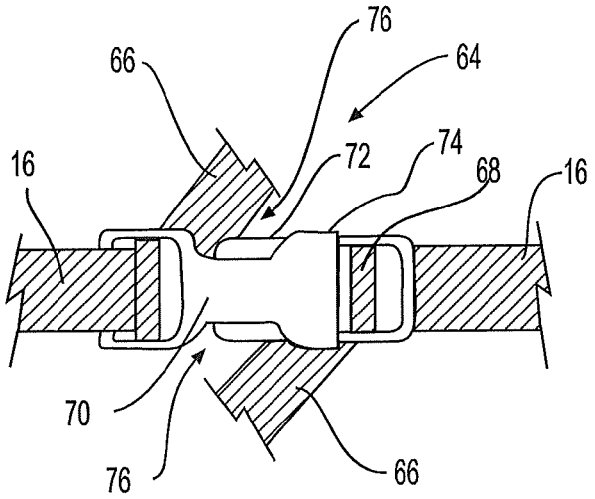
FIG. 6 is a top view of one example of a latched buckle that may be used in accordance with this disclosure.
Figure 7:
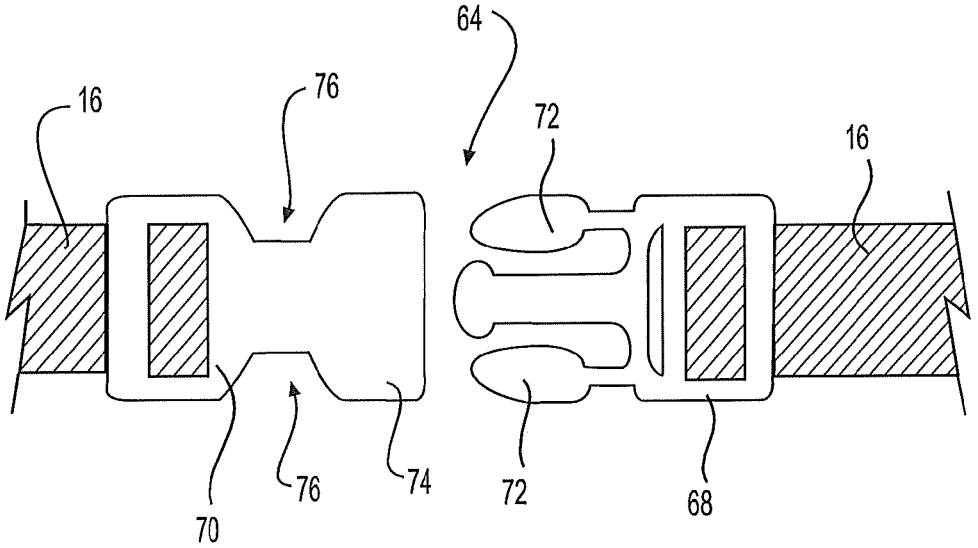
FIG. 7 is a top view of a non-latched buckle that may be used in accordance with this disclosure.

FIG. 6 is a top view of a buckle 64 in a closed position in accordance with an embodiment. FIG. 7 is a top view of the buckle 64 in an open position. With reference to both FIGS. 6 and 7, the straps 16 are shown attached to the buckle 64 and the strap ends 66 are shown. In some embodiments, the strap 16 may be tightened by pulling on the strap ends 66. The buckle 64 may be a common snapping type buckle 64. The buckle 64 may include an interior buckle 68 that fits with an exterior buckle 70 to snap in place. The interior buckle may include flexing fingers 72 that are compressed together when entering the compression end of the exterior buckle 70.

Once the flex fingers 72 have moved beyond the compressing end 74 to the locking cutouts 76, the flex fingers 72 may move outwardly thereby locking the interior buckle 68 to the exterior buckle 70. To unlock and remove the interior buckle 68 from the exterior buckle 70, a user may compress the flex fingers 72 towards each other, and then simply slide the interior buckle 68 out of the exterior buckle 70 as shown in FIG. 7. The particular buckles 64 shown are meant to be examples only. Other types of buckles or fasteners may be used in accordance with this disclosure.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An effluent container comprising:

multiple sheets of material attached together to form a generally rectangular shape, having a front sheet, a back sheet, two side sheets, and a bottom sheet, wherein the back sheet is taller than the front sheet and the two side sheets;

securing loops attached to a free end of at least one of the multiple sheets and configured to attach the effluent container to a support structure; and a drain located on one of the sheets, proximate to the bottom sheet, the drain configured to provide selective fluid communication between an interior of the container and an outside of the container.

2. The effluent container of claim 1, wherein at least one of the multiple sheets has a multi-ply construction.

3. The effluent container of claim 1, further including a second drain, located proximate to the bottom sheet the second drain configured to provide selective fluid communication between the interior of the container and the outside of the container.

4. The effluent container of claim 1, wherein the multiple sheets are attached to each other at seams, wherein the seams are formed by, at least one of any of the following: heat welding, chemical welding, an adhesive, sewing, impulse welding, and sonic welding.

5. The effluent container of claim 1, further comprising a first closure system located on a first side sheet of the two side sheets and configured to selectively open and close and form a slit in the first side sheet when the first closure system is in an open position.

6. The effluent container of claim 1, wherein the front sheet is located opposite the back sheet and taller than the two side sheets.

7. The effluent container of claim 6, wherein the back wall is about 6 feet high, the front wall is about 4 feet high and the sidewalls are about 3.5 feet high.

8. The effluent container of claim 1, wherein the container is between about 2 and about 20 feet long.

9. The effluent container of claim 1, wherein the securing loops include the same material used to form the multiple sheets.

10. The effluent container of claim 9, wherein the securing loops further include straps threaded through the loops.

11. The effluent container of claim 10, wherein the straps include buckles.

12. The effluent container of claim 1, wherein the material is made of polyethylene reinforced with nylon.

13. The effluent container of claim 12, wherein the nylon is in the form of fibers in a grid pattern embedded in the polyethylene.

14. The effluent container of claim 1, wherein the drain includes at least one of a two and three inch fitting.

15. The effluent container of claim 1, wherein the back sheet has a single horizontal seam nearer the bottom sheet than the free end of the back sheet.

16. An effluent container comprising:

multiple sheets of material attached together to form a generally rectangular shape, having a front sheet, a back sheet, two side sheets, and a bottom sheet;

means for closing a slit located on a first side sheet and configured to selectively open and close and form a slit in a first side sheet when the means for closing is in an open position;

means for securing the container to a structure attached to a free end of at least one of the sheets; and means for draining the container located on one of the sheets, proximate to the bottom sheet, the means for draining configured to provide selective fluid communication between the interior of the container and an outside of the container.

17. An effluent container comprising:

multiple sheets of material attached together to form a generally rectangular shape, having a front sheet, a back sheet, two side sheets, and a bottom sheet;

securing loops attached to a free end of at least one of the multiple sheets and configured to attach the effluent container to a support structure;

a drain located on one of the sheets, proximate to the bottom sheet, the drain configured to provide selective fluid communication between an interior of the container and an outside of the container; and a first closure system located on a first side sheet of the two side sheets and configured to selectively open and close and form a slit in the first side sheet when the first closure system is in an open position.

18. The effluent container of claim 17 further comprising a second closure system located on a second side sheet of the two side sheets opposite of the first closure system, wherein the second closure system is configured to selectively open and close and form a second slit in the second side sheet when the second closure system is in an open position.

19. The effluent container of claim 17, wherein the first closure system includes a hook and loop fastening system.

20. An effluent container comprising:

multiple sheets of material attached together to form a generally rectangular shape, having a front sheet, a back sheet, two side sheets, and a bottom sheet, wherein the material is made of polyethylene reinforced with nylon;

securing loops attached to a free end of at least one of the multiple sheets and configured to attach the effluent container to a support structure; and a drain located on one of the sheets, proximate to the bottom sheet, the drain configured to provide selective fluid communication between an interior of the container and an outside of the container.

21. The effluent container of claim 20, wherein the nylon is in the form of fibers in a grid pattern embedded in the polyethylene.

22. An effluent container comprising:

multiple sheets of material attached together to form a generally rectangular shape, having a front sheet, a back sheet, two side sheets, and a bottom sheet, wherein the back sheet has a single horizontal seam nearer the bottom sheet than the free end of the back sheet;

securing loops attached to a free end of at least one of the multiple sheets and configured to attach the effluent container to a support structure; and a drain located on one of the sheets, proximate to the bottom sheet, the drain configured to provide selective fluid communication between an interior of the container and an outside of the container.

* * * * *